US005112698A

United States Patent [19]

Horvei et al.

[11] Patent Number: 5,112,698

[45] Date of Patent: May 12, 1992

[54] CERAMIC COATING

[75] Inventors: Knut Horvei; Jonas S. Sandved, both of Sandnes, Norway

[73] Assignee: Den norske stats oljeselskap a.s, Norway

[21] Appl. No.: 588,142

[22] Filed: Sep. 25, 1990

Related U.S. Application Data

[62] Division of Ser. No. 317,084, Feb. 28, 1989, Pat. No. 4,988,538.

[30] Foreign Application Priority Data

Apr. 30, 1986 [NO] Norway ..... 861700

[51] Int. Cl.[5] ..... B32B 15/04

[52] U.S. Cl. ..... 428/632; 428/633; 428/679; 428/472; 428/687; 501/132

[58] Field of Search ..... 428/632, 633, 679, 472, 428/687; 501/132

[56] References Cited

U.S. PATENT DOCUMENTS

| | | | |
|---|---|---|---|
| 2,607,983 | 8/1952 | McBride . | |
| 2,775,531 | 12/1956 | Montgomery et al. . | |
| 3,006,782 | 10/1961 | Wheildon . | |
| 3,310,423 | 3/1967 | Ingham . | |
| 3,789,096 | 1/1974 | Church et al. . | |
| 4,377,371 | 3/1983 | Wisander et al. . | |
| 4,823,359 | 4/1989 | Ault et al. | 501/132 X |

FOREIGN PATENT DOCUMENTS

| | | |
|---|---|---|
| 0197374 | 10/1986 | European Pat. Off. . |
| 0199084 | 10/1986 | European Pat. Off. . |
| 3310650 | 3/1984 | Fed. Rep. of Germany . |
| 3608286 | 3/1986 | Fed. Rep. of Germany . |
| 57-39956 | 8/1982 | Japan . |

OTHER PUBLICATIONS

Patent Abstracts of Japan, vol. 10, No. 287 (C-375) (2343) Sep. 30, 1986; & JP-A-61 104 062 (Tsukishima Kikai Co. Ltd.) May 22, 1986.

World Patents Index Latest, database, Derwent Pub. Ltd., London, G.B.; Accession No. 86-321385, Week 49; & JP-A-61 159 577 (Mitsubishi Heavy Ind. KK) Jul. 19, 1986.

"Performance of Laser Glazed $ZrO_2$ TBCs in Cyclic Oxidation and Corrosion Burner Rig Tests"-I. Zaplatynsky, NASA Technical Memorandum 82830.

Chemical Abstracts, vol. 101, 1984, ref. No. 215418 g, vol. 96, 1982, ref. No. 107959 d, vol. 92, 1980, ref. No. 201655 r, vol. 103, 1985, ref. No. 219743 y.

"Character of Laser-Glazed, Plasma-Sprayed Zirconia Coatings on Stainless Steel Substrata"-G. S. Fischman et al., pp. 908-919.

*Primary Examiner*—Karl Group

*Attorney, Agent, or Firm*—Lucas & Just

[57] ABSTRACT

A ceramic chromium oxide coating produced by applying a conventional chromium oxide coating to a substrate and wholly or partly fusing the conventional chromium oxide coating by subjecting the chromium oxide coating to laser irradiation. The chromium oxide coating can optionally contain silica and/or alumina and less than 1 percent of metal.

The chromium oxide coating can be employed for the internal and/or external protection of components in equipment for production and transport of oil and gas under water.

20 Claims, 3 Drawing Sheets

CERAMIC COATING

This is a division of application Ser. No. 317,084, filed Feb. 28, 1989, now U.S. Pat. No. 4,988,538.

The present invention relates to a ceramic chromium oxide coating which is resistant to wear and offers protection against corrosion. Furthermore, the invention relates to a method for producing such a metal oxide coating and finally, the invention involves a utilization of the coating.

Very considerable strains are placed on materials which are used in connection with oil and gas production, especially at medium to great sea depths. Coatings which are resistant to wear and protect against corrosion can be used in order to increase a component's capability to resist serious wear and corrosion, and thereby reduce the need for maintenance and increasing their life span.

The demands on such coatings are extremely severe. Reference may, for instance, be made to large transport pipelines for oils and gas. At vulnerable places, wear and corrosion are a serious problem. In this case, one single coating should offer both resistance to wear and protection against corrosion.

Regarding corrosion, the coating should be an effective barrier against seawater and also against oils and gases which contain water, salts, hydrogen sulphide, and carbon dioxide. The hydrostatic pressure of the seawater during storage reaches 50 atmospheres or more and oil/gas pressure during the production periods reaches 200 atmospheres. In addition to the high pressures, the coating must be able to withstand an oil/gas temperature of 150° C. without suffering destruction. The lifespan of such a coating should be towards 50 years.

The mechanical wear is caused by particles in the oil/gas flow, and by mechanical pigs used for internal inspection and cleaning of the pipelines.

Similar requirements to the quality of materials are demanded elsewhere, for example, in the processing industry, astronautics, aeronautics, and the mechanical industry.

Ceramic metal oxide coatings have several advantages, namely, they are electro-chemically dead, electrically insulating, and extremely hard. These coatings provide good protection against abrasive wear. One of the best ceramic metal oxide coatings is chromium oxide, $Cr_2O_3$, with a dense and relatively ductile structure.

However, the application of chromium oxide on top of another material is, to a certain extent, problematic. For a number of desirable substrates, the temperature to which the substrate can be raised is not allowed to exceed a certain limit because, at temperatures higher than these, the mechanical properties of the substrate are reduced. For components of steel, this upper limit is approximately 400° C., while for aluminium it is only 150° to 200° C. This means that for coating with chromium oxide materials, high temperature sintering processes cannot be used.

Suitable methods for applying ceramic metal oxide coatings are plasma spraying or slurry application. Both of these methods guarantee a suitable low temperature in the substrate. Plasma spraying can be used on all sorts of substrates since cooling can be satisfactorily controlled.

Plasma spraying of chromium oxide generally provides good adherence to the substrate material. However, the resulting coatings are porous and lead to severe problems of corrosion in seawater. Experiments show also that wear and tear properties (heavy abrasive wear, ASTM G65) of plasma sprayed chromium oxide coatings tend to be less than desired (such will be more fully explained below). This may be due to the fact that individual chromium oxide particles solidify so quickly on collision with the substrate that any sintering between the chromium oxide particles in the coating will be incomplete. This incomplete sintering makes the coating rather porous and results in pores right through to the substrate. Heavy wear and tear causes the individual particles to peel off, layer by layer.

Slurry-applied coatings can be considerably more dense and thus more suitable for protection against corrosion. The wear characteristics of these coatings are also much better in dry conditions. This can probably be explained by the fact that these coatings are built up of very fine grains. Experiments have shown, however, that in wet conditions (sand mixed with 3% NaCl dissolved in water), the wear and tear properties of slurry-applied coatings are reduced, making them comparable to plasma-sprayed chromium oxide coatings.

So, for several applications, the properties of chromium oxide coatings applied by either plasma spraying or slurry application are less than satisfactory.

The object of the present invention is to provide a coating that exhibits hardness, durability and resistance against corrosion and which surpasses those currently commercially available so that the coating can be used to protect vital components against considerable strains associated with the action of temperature, corrosion and wear. In accordance with the present invention, the chromium oxide coating will be particularly suitable for the protection of components in pipes, valves and pumps in various transport systems, especially in transport pipelines and underwater completion systems for oil and gas located on the seabed and in petroleum processing plants. The present invention relates to a durable and corrosion protective chromium oxide coating which is characterized by being produced by treating a chromium oxide coating which is applied to the substrate by conventional methods, such as by high efficiency laser beams.

The present invention also relates to a corresponding method for producing such a coating.

Finally, the present invention relates to a particular application of such a laser treated chromium oxide coating on components such as pipelines (internally as well as externally), valves and pumps in underwater transport systems and other kinds of equipments for treating oil and gas.

Figure 1:
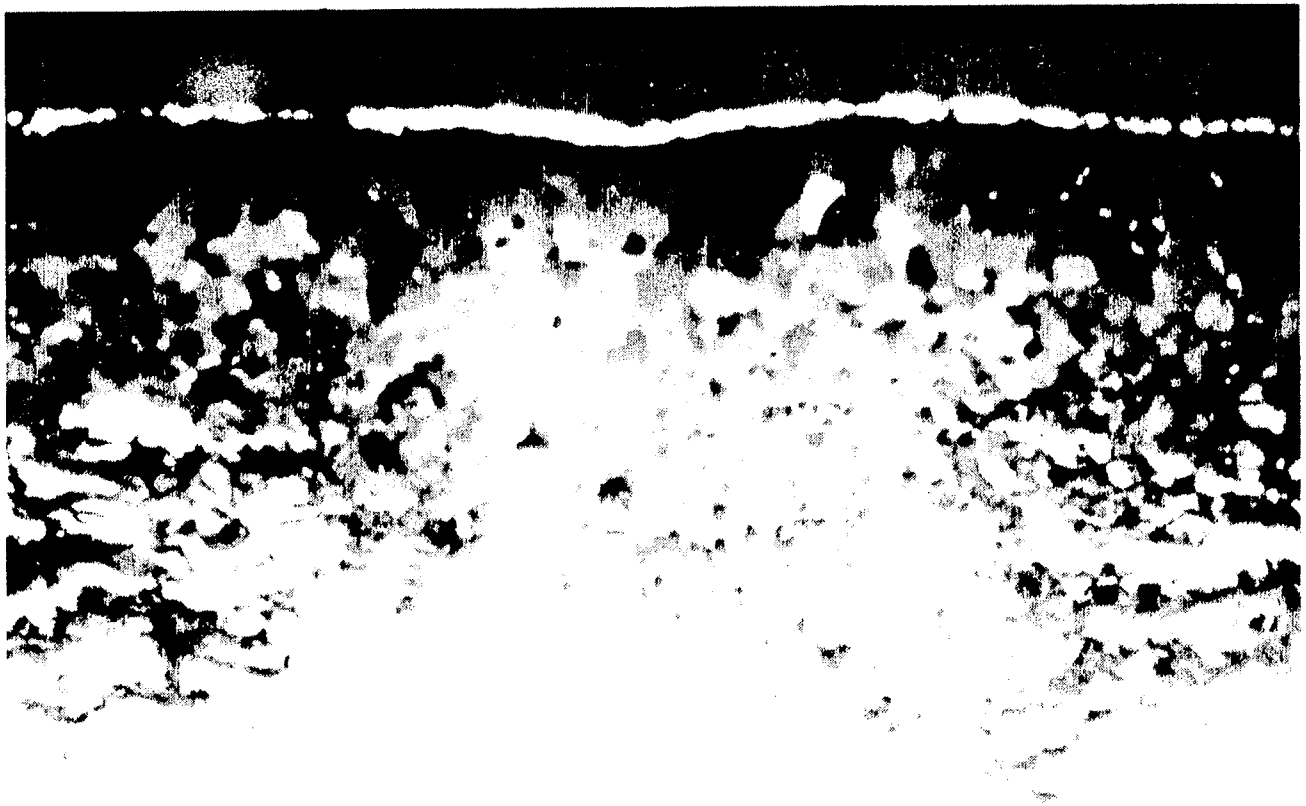
FIG. 1 shows a cross-section of a coating made in accordance with the present invention.

Broadly, the ceramic coating of the present invention is produced wholly or partially by melting a ceramic coating containing chromium oxide. The melting is conducted by laser irradiation. The ceramic chromium oxide coating may optionally contain silica or alumina. Additionally, the ceramic chromium oxide coating may contain less than about 1.0 by weight of other metallic elements.

More specifically, the substrate is substantially unaffected by the melting of the coating material, the laser irradiation being carried out by employing a laser capable of producing a beam having a wavelength of approximately 10 μm, at a power density of at least 1 $kW/cm^2$, and with a treatment rate of at least 1 $cm^2/min$.

During the production of the chromium oxide coating, it is advantageous tc take into account the substrate material. Thus, it is desirable to deposit the coating by means of conventional methods which ensure that the temperature of the substrate does not exceed the limit which weakens the mechanical properties of the underlying material.

During the treatment of the chromium oxide coating with laser beams, the coating material will be wholly or partly remelted. On solidifying, a finely grained equiaxial, homogeneous microstructure will arise. The individual crystal grains in the coating will, therefore, become chemically bonded to each other and good adherence to the substrate will be achieved. Typical methods of application are flame spraying, plasma spraying, and slurry application.

During plasma spraying, the chromium oxide particles in the plasma flame melt and are thrown with supersonic speed against the surface which is to be coated. On collision with the surface, the drops are squashed flat—like pancakes—and instantly quenched. The coating is thus built up in layers of half-sintered "pancakes," and gives plasma-applied coatings a characteristic structure, a cross-section of such a coating being observable under a microscope. This build up of the coating results in a certain porosity which leads to a reduction of some of the material properties of the coating; for instance, this will enable fluids and gas to penetrate such a coating as time passes. Further, the thermal gradients created during the application by this method will lead to a build up of internal tension in the coating, in this way setting a practical limit to the thickness of the coating.

A dramatic change in the structure of the chromium oxide coating is achieved by laser glazing a plasma sprayed chromium oxide coating. After laser treatment, it is observed that the chromium oxide phase in the coating has developed a typical, almost equiaxial, finely grained structure. The homogeneity of the material has become very considerably improved. Generally, it has been observed that, in the top layer of the coating, there is a coarser grain structure than in the lower layer, which is assumed to be due to greater effect of heat on the upper part.

The invention is particularly suitable for the coating of metal, especially steel. However, it is evident that the invented coating and the method for its production can also be employed on other materials such as semi-conductor, ceramic, and polymer materials.

In order to produce an improved adherent layer between a metal surface and the chromium oxide coating, it is preferable to plate the underlying material with, for example, nickel.

Before laser glazing, the coating can be impregnated one or more times with chromium oxide, for example, in the form of $H_2CrO_4$, as described in U.S. Pat. No. 3,789,096, incorporated herein by reference. One achieves, thereby, a relatively poreless and crackless coating material which is suitable for laser glazing.

For metal components in a marine environment, it is important to prevent corrosion. By using the coating according to the present invention, it is possible to reduce corrosion currents to below 0.05 $\mu A/cm^2$ during a time span of at least 100 days. Together with other properties, this makes the coating particularly useful for internal and external protection of exposed components in pipes, valves and pumps in equipment for the production and transport of oil and gas under water, particularly offshore.

For laser glazing, it is preferable to use a laser which is capable of producing beams with a wavelength of approximately 15 μm, for example a $CO_2$ laser, and having a power density of at least 1 $kW/cm^2$. The rate of carrying out the treatment should preferably be at least 1 $cm^2/min$.

These and other aspects of the present invention may be more fully understood with reference to the following examples.

EXAMPLE 1

A $Cr_2O_3$ coating of approximately 0.2 mm thickness was applied to nickel plated steel rods. Glazing with a laser beam ($CO_2$ laser, 2.5 $kw/cm^2$, 6 $cm^2/min.$) provided a chromium oxide coating having a fine grained and approximately equiaxial structure and considerably improved homogeneity compared to coatings not having been laser glazed. FIG. 1 shows a cross-section through the laser glazed coating at 300x magnification. Uppermost a finely crystallized chromium oxide layer (dark to light gray polygons) can be seen, whereas the metal substrate (white) appears below. A bonding layer is comprised by metal and chromium oxide in mixture.

EXAMPLE 2

A $Cr_2O_3$ coating was applied to samples of steel by plasma spraying. Some of these samples were subjected to the laser glazing process described in Example 1. The microhardness of the coatings was measured on a metallographic grinding of the cross-section of the coating according to Vicker's method with loads of 0.3 kg. The microhardness of the plasma sprayed coatings was in the region of about 800 to about 1300 $HV_{0.3}$, whereas the corresponding values for the laser glazed coatings were about 1600 to about 2000 $HV_{0.3}$. Thus, the laser glazed coatings display a considerable gain in hardness and the test results are also less scattered.

EXAMPLE 3

Figure 2:
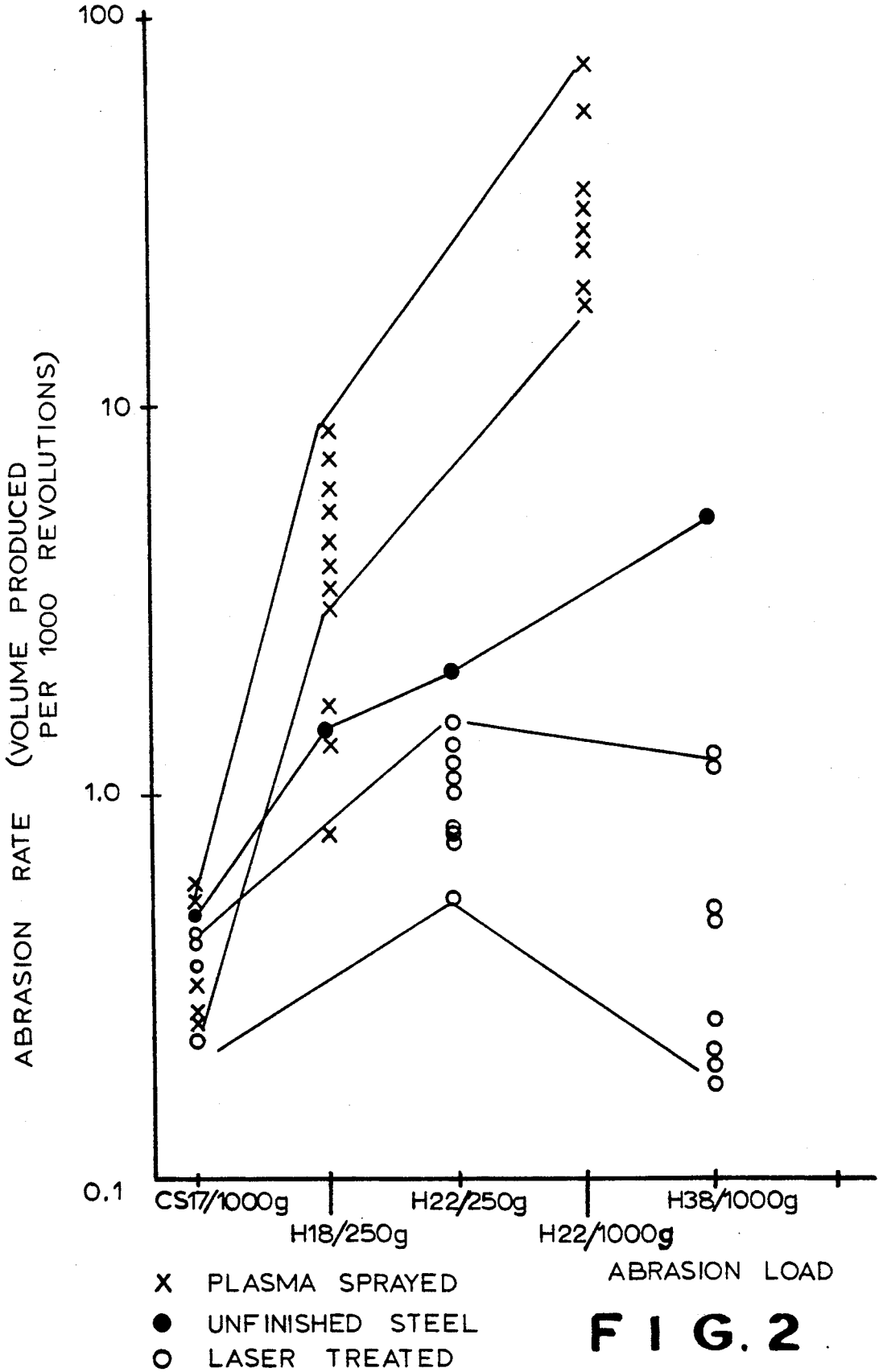
FIG. 2 shows the rate of wear (abrasion) of a substrate coated by plasma spraying, an uncoated substrate, and a substrate coated in accordance with the present invention.

Abrasive tests were carried out by means of a standardized Taber Abrazer (ASTM C 501-80). This kind of equipment is employed for testing dry abrasion. The samples are placed on a rotating table, and two abrasive wheels loaded by weights are placed on the samples. The wheels are made of matrix materials of various hardness with harder particles imbedded into the matrix. The abrasive wheels run freely on the samples, and the abrasive movement, therefore, consists of a combination of roll and twist. FIG. 2 shows the abrasive rate, in volume, produced per 1000 revolutions as a function of increasing abrasive loads under stationary conditions. The partition of the abscissa is arbitrary. The numbers above the slash indicate the hardness of the abrasive wheel and the numbers below the slash indicate the weight load on the abrasive wheel. Thus, H22/1000 g indicates a larger abrasion than H22/250 g and H38/1000 g indicates a larger abrasion than H22/1000 g.

Samples prepared in the same procedure as according to Example 2 were subjected to these kinds of abrasive tests. The results appear from FIG. 2. If the chromium oxide coating is subjected to heavy abrasion, it is apparent that the abrasive qualities of the plasma-sprayed coating may be improved by a factor of 10 to 100 by laser glazing. The reason for this may be related to the observed modification of the microstructure. As the plasma-sprayed coating is made up of co-sintered "pancakes," abrasion may easily lead to spalling and fragments being torn off the surface, thereby producing a larger amount of abraded material. During laser glazing, a remelting of the coating is achieved providing a thoroughly sintered, homogeneous and fine grained structure. A material having this structure will not be subjected to a similar tearing action when exposed to abrasion.

In order to elucidate this point a bit further, abrasive tests were also carried out on bare steel. The results from these tests indicate the wearing characteristics of steel to be intermediate of those of the plasma-sprayed coatings and those of the laser glazed coatings.

EXAMPLE 4

Specimens of steel are coated with a single (not graded) layer of NiAlMo ("Lastolin 188990") and are plasma-sprayed with chromium oxide powder of the type "Metco 136F." A coating thickness of about 0.5 mm is thus achieved. After laser glazing ($CO_2$ laser, 2.5 $kW/cm^2$ and treatment rate of 4 $cm^2/min.$) a coating is attained with durability rates of approximately 0.2 $mm^3/1000$ revolutions measured according to the method described in Example 3.

EXAMPLE 5

Chromium oxide power (90 g) and a binding medium (10 g) consisting mainly of finely ground quartz and calcium silicates are mixed thoroughly with water (25 ml) to a creamy consistency. Specimens of steel are dipped into the mixture (the slurry) and are drip-dried before being dried at a temperature of 300° C. in a drying cabinet. Laser glazing ($CO_2$ laser, 2.5 $kW/cm^2$, 4 $cm^2/min.$) produces a chromium oxide coating with a rough surface and uneven thickness.

Thicker coating can be produced by repeating the process several times. Such multicoatings are preferably built up of single coatings, each with a thickness of less than 50 μm.

EXAMPLE 6

A piece of steel coated with a mixture of chromium oxide and silica and impregnated 10x with $H_2CrO_4$ according to the method described in U.S. Pat. No. 3,789,096 was subjected to laser treatment. Steel samples with such coatings can be attained from the British firm Monitox. According to elemental analysis, the coating contained equal weight parts of chromium oxide ($Cr_2O_3$) and silica ($SiO_2$) and small amounts of iron and zinc ($<1\%$ by weight).

At a power density of 11.5 $J/mm^2$, which is equivalent to a laser power of 2.9 kW on a "window" of 6×6 mm at a rate of 2 m per min. and a conversion factor of 0.8, there was achieved a more or less continuouos glazed coating with a somewhat irregular thickness.

Figure 3:
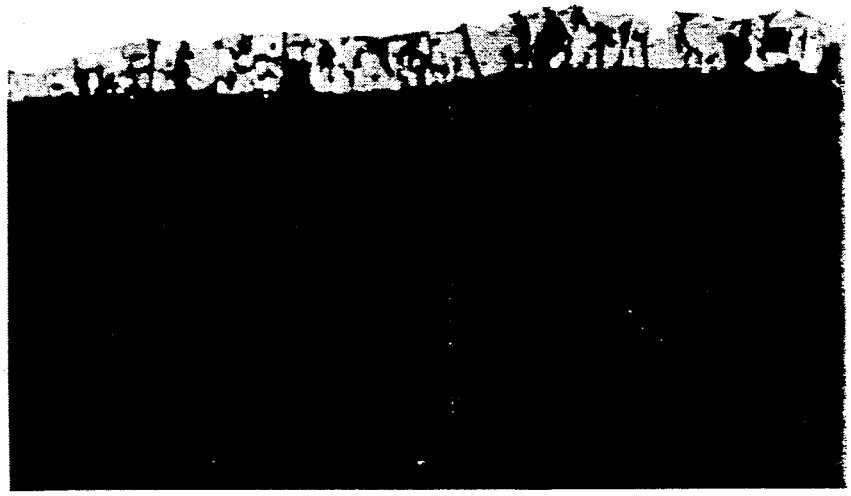
FIG. 3 shows a cross-section of another coating made in accordance with the present invention.

FIG. 3 shows a cross-section of the coating in 400x magnification (FIG. 3 is made up of several photos). The coating is seen here in grey on the metal surface (dark). In this section there are a few pores (dark patches), but no cracks. The coating was originally 150 μm thick.

It will be understood that the preferred embodiments of the present invention herein chosen for the purpose of illustration are intended to cover all changes and modifications of the preferred embodiments of the present invention which do not constitute a departure from the spirit and scope of the present invention.

What is claimed is:

1. A structure comprising a metal substrate having a ceramic coating composition deposited thereon, said ceramic coating composition being characterized by being produced by first applying a chromium oxide containing coating material to said substrate and, subsequently, glazing said chromium oxide coating material by means of laser irradiation, whereby the coating material is at least partially melted and chemical bonds form in the coating material while leaving the substrate essentially unaffected.

2. Structure of claim 1 wherein said coating composition contains one or more components selected from the group consisting of silica, alumina, and calcium silicate.

3. The structure composition of claim 1 wherein the laser irradiation is carried out by employing a laser capable of providing a beam having a wavelength of approximately 10 μm, at a power density of at least 1 $kW/cm^2$ and with a treatment rate of at least 1 $cm^2/min.$

4. The structure composition of claim 1 wherein the substrate material is substantially unaffected by the melting of the chromium oxide containing coating material.

5. The structure of claim 1 wherein, prior to glazing, the applied coating material is impregnated with chromium oxide.

6. The structure composition of claim 1 wherein the substrate is a steel that has been plated with nickel prior to applying the coating composition.

7. The structure of claim 1 wherein said ceramic chromium oxide coating material is applied to said substrate by a method selected from the group consisting of flame spraying, plasma spraying, and slurry application.

8. A structure comprising a ceramic coating composition deposited on a metal substrate. which composition is obtained by applying a ceramic chromium oxide coating material to said substrate to form a coat of ceramic chromium oxide on said substrate; impregnating said ceramic chromium oxide material with chromium oxide precursor prior to glazing and forming a substantially poreless and crackless chromium oxide coating by glazing said coat of ceramic chromium oxide by means of laser irradiation to at least partially melt said coating and cause chemical bonding in said coating and leaving the substrate essentially unaffected by the melting of the coating material, thereby making said ceramic coating corrosion and wear resistant and substantially poreless and crackless.

9. The structure of claim 8 wherein the substrate is steel and the ceramic coating composition further comprises the step of plating said substrate with nickel prior to applying the ceramic chromium oxide material to said substrate.

10. The structure of claim 8 wherein said ceramic chromium oxide material is applied by means of thermal spraying, plasma spraying, or slurry application.

11. The structure of claim 8 wherein said laser irradiation is conducted by means of a laser capable of producing a beam having a wavelength of approximately 10 μm, at a power density of at least 1 $kW/cm^2$ and with a treatment rate of at least 1 $cm^2/min.$ 12. The ceramic coating composition of claim 8 wherein said coating contains in addition to chromium oxide one or more components selected from the group consisting of silica, alumina, and calcium silicate.

13. A structure comprising an improved corrosion and wear resistant coating composition deposited on a metal substrate, said composition obtained by first applying a ceramic chromium oxide coating material to said substrate to form a coat of said material on said substrate and, subsequently, glazing said coat by means of laster irraadiation to at least partially melt said coat and cause chemical bonding in said coat while leaving said substrate essentially unaffected, thereby making said coat having an abrasion rate of less than 2 at an abrasion load of H38/1000 g.

14. The structure of claim 13 wherein the substrate is steel and the ceramic coating composition further comprises the step of plating said substrate with nickel prior to applying the ceramic chromium oxide material to said substrate.

15. The structure of claim 13 wherein said ceramic chromium oxide material is applied by means of thermal spraying, plasma spraying, or slurry application.

16. The structure claim 13 wherein, prior to glazing, the applied coating material is impregnated with chromium oxide.

17. The structure of claim 13 wherein said coating composition contains one or more components selected from the group consisting of silica, alumina, and calcium silicate.

18. The structure of claim 1 wherein the substrate is a pipeline component.

19. The structure of claim 1 wherein the substrate is a valve component.

20. The structure of claim 1 wherein the substrate is a pump.

* * * * *

UNITED STATES PATENT AND TRADEMARK OFFICE

CERTIFICATE OF CORRECTION

PATENT NO. : 5,112,698

DATED : May 12, 1992

INVENTOR(S) : Knut Horvei et al.

It is certified that error appears in the above-identified patent and that said Letters Patent is hereby corrected as shown below:

Column 2, line 65, after "silica" insert --, calcium silicate--.

Column 2, line 67, after "1.0" insert --%--.

Column 3, line 9, change "tc" to --to--.

Column 5, line 61, change "continuouos" to --continuous--.

Column 6, line 18, delete "Structure" and substitute therefor --The structure--.

Column 6, line 21, delete "composition".

Column 6, line 26, delete "composition".

Column 6, line 33, delete "composition".

Column 6, line 34, change "substtrate" to --substrate--.

Column 6, line 35, change "composition" to --material--.

Column 7, line 1, delete "ceramic coating composition" and substitute therefor --structure--.

UNITED STATES PATENT AND TRADEMARK OFFICE

CERTIFICATE OF CORRECTION

PATENT NO. : 5,112,698

DATED : May 12, 1992

INVENTOR(S) : Knut Horvei et al.

It is certified that error appears in the above-identified patent and that said Letters Patent is hereby corrected as shown below:

Column 7, line 11, change "irraadiation" to --irradiation--.

Signed and Sealed this

Thirteenth Day of October, 1992

*Attest:*

DOUGLAS B. COMER

*Attesting Officer*

*Acting Commissioner of Patents and Trademarks*